US012453403B2

(12) United States Patent
Sanchez et al.

(10) Patent No.: US 12,453,403 B2
(45) Date of Patent: Oct. 28, 2025

(54) DEVICE FOR PACKAGING A COSMETIC PRODUCT IN THE FORM OF A STICK

(71) Applicant: L'OREAL, Paris (FR)

(72) Inventors: Marcel Sanchez, Clichy (FR); Francois Boucher, Clichy (FR); Stephane Maire, Clichy (FR)

(73) Assignee: L'OREAL (FR)

( * ) Notice: Subject to any disclaimer, the term of this patent is extended or adjusted under 35 U.S.C. 154(b) by 0 days.

(21) Appl. No.: 18/689,681

(22) PCT Filed: Sep. 13, 2022

(86) PCT No.: PCT/EP2022/075451
§ 371 (c)(1),
(2) Date: Mar. 6, 2024

(87) PCT Pub. No.: WO2023/041543
PCT Pub. Date: Mar. 23, 2023

(65) Prior Publication Data

US 2024/0389736 A1 Nov. 28, 2024

(30) Foreign Application Priority Data

Sep. 14, 2021 (FR) ..... 2109615

(51) Int. Cl.
*A45D 40/06* (2006.01)
*A45D 40/00* (2006.01)
*A45D 40/16* (2006.01)

(52) U.S. Cl.
CPC ..... *A45D 40/06* (2013.01); *A45D 40/16* (2013.01); *A45D 2040/0012* (2013.01); *A45D 2040/0062* (2013.01)

(58) Field of Classification Search
CPC ..... A45D 40/06; A45D 40/16; A45D 2040/0062; A45D 40/00;
(Continued)

(56) References Cited

U.S. PATENT DOCUMENTS 2,858,937 A * 11/1958 Hoffman ..... A45D 40/06 401/63
3,333,689 A 8/1967 Terrill et al.
(Continued)

FOREIGN PATENT DOCUMENTS

CN 206744845 U 12/2017
CN 207821342 U 9/2018
(Continued)

OTHER PUBLICATIONS

International Search Report (ISR) for PCT/EP2022/075451 mailed Oct. 12, 2022 (3 pages).
(Continued)

*Primary Examiner* — David J Walczak
(74) *Attorney, Agent, or Firm* — Jason A. Smith; Shumaker, Loop & Kendrick, LLP

(57) ABSTRACT

A device for packaging a lipstick, having a lipstick distributor mechanism, having a proximal part and a rotary distal part, configured such that the rotary movement of the distal part with respect to the proximal part is accompanied by an axial movement of the stick relative to the proximal part, a case having a body made of mineral glass, into which said mechanism can be fitted and secured.

16 Claims, 13 Drawing Sheets

(58) Field of Classification Search
CPC .... A45D 2040/0006; A45D 2040/0012; A45D 40/0068; A45D 40/02; A45D 40/205; A45D 2040/208; B65D 83/0005; B65D 83/0011
USPC ..... 401/75–78, 98, 192; 206/385
See application file for complete search history.

(56) References Cited

U.S. PATENT DOCUMENTS

| | | | | |
|---|---|---|---|---|
| 3,591,298 | A * | 7/1971 | Green | A45D 40/06 D28/86 |
| 4,311,402 | A * | 1/1982 | Brown | A45D 40/06 401/98 |
| 4,422,545 | A * | 12/1983 | Kadoory | A45D 40/06 401/98 |
| 4,579,134 | A | 4/1986 | Moore | |
| 6,561,711 | B1 | 5/2003 | Pierpont | |
| 7,144,171 | B2 | 12/2006 | Blondeel et al. | |
| 8,328,445 | B2 * | 12/2012 | Martins | A45D 40/16 401/78 |
| 2013/0230347 | A1 | 9/2013 | Kim | |

FOREIGN PATENT DOCUMENTS

| | | | |
|---|---|---|---|
| CN | 208725025 | U | 4/2019 |
| CN | 211021359 | U | 7/2020 |
| CN | 111671225 | A | 9/2020 |
| FR | 2923997 | A1 | 5/2009 |
| GB | 598838 | A | 2/1948 |
| JP | S60168410 | U | 11/1985 |
| JP | H08256833 | A | 10/1996 |
| KR | 20170003413 | U | 10/2017 |

OTHER PUBLICATIONS

Written Opinion (WO) for PCT/EP2022/075451 mailed Oct. 12, 2022 (4 pages).
English translation of Feb. 17, 2025 JP Office Action for JP Pat. App. 2024 516498 (4 pages).
Office Action from the Korean Patent Office dated Jun. 23, 2025.

* cited by examiner

DEVICE FOR PACKAGING A COSMETIC PRODUCT IN THE FORM OF A STICK

The present invention relates to devices for packaging a lipstick or other product in the form of a stick.

BACKGROUND

Devices for packaging a lipstick conventionally have a lipstick distributor mechanism having a proximal part and a rotary distal part, this mechanism being configured such that the rotary movement of the distal part with respect to the proximal part is accompanied by an axial movement of the stick relative to the proximal part, and a case in which said mechanism can be fitted and secured.

The cases found on the market are usually made of plastics material and are not generally intended to be reused.

U.S. Pat. No. 6,561,711, CN206744845, CN207821342, CN111671225, CN211021359 and CN208725025 describe devices for packaging a lipstick, having a distributor mechanism and a protective case made of transparent plastics material.

SUMMARY

There is a need to benefit from a device for packaging and applying a lipstick that encourages the user to keep the case in order to reuse it for a new mechanism once the stick has been used up, while being attractive to the consumer.

The invention meets this need by way of a device for packaging a cosmetic product in the form of a stick, in particular a lipstick, having:

- a distributor mechanism, having a proximal part and a rotary distal part, configured such that the rotary movement of the distal part with respect to the proximal part is accompanied by an axial movement of the stick relative to the proximal part,
- a case having a body made of mineral glass, in which said mechanism can be fitted and secured.

The use of mineral glass provides durability, and makes it possible to reuse the case without fear of deterioration of its aesthetic appearance, since glass is a material which is difficult to scratch.

Moreover, the case can be cleaned easily, where appropriate.

On account of its weight, the case also provides stability in a vertical position, thereby making it possible to store it vertically with other products or accessories.

The case also makes it possible, when the body is transparent, to see the colour of the stick through the case, without it being necessary to remove the case, thereby saving the user time when they need to choose between several products.

Glass also provides effective protection against UV rays, lateral and axial mechanical pressures, and provides the case with a pleasant cold feel.

The case can be made with exterior dimensions that make it compatible for use on existing display stands.

The mechanism is known per se and includes any system for converting the rotary movement into an axial movement. Numerous mechanisms are provided on the market. Examples of mechanisms, among others, are described in the patents U.S. Pat. Nos. 3,333,689 and 7,144,171.

Preferably, the glass body has a neck and the case has a ring made of thermoplastic material which is attached and secured to the neck and to which said mechanism is secured. Such a ring makes it possible to manufacture the body with fairly large manufacturing tolerances, while allowing precise mounting of the mechanism on the case.

The ring may have at least two securing tabs on the neck, better still four.

The neck may have at least one positioning relief forming a protrusion on its outer surface, in particular in the form of a tooth, and at least one of the securing tabs of the ring may have a recess for receiving said relief.

At least some of the securing tabs have, on a radially inner face, a snap-fastening tooth, said recess being formed by an interruption in the tooth. The neck may have two diametrically opposite positioning reliefs, two of the securing tabs of the ring having corresponding recesses.

The case preferably has a cover, also referred to as a "cup", which is in particular metallic and designed to be secured to said ring. This cover contributes to the appearance of the case and may also have a function of retaining the ring.

The cover can be secured in various ways.

The securing tabs may have, on their outer face, ribs for retaining the cover, against which the cover bears. The cover may make it possible, by bearing on the tabs, to keep the latter on the neck, thereby making it more difficult to accidentally detach the ring.

The ring may also have at least one relief which is designed to be snap-fastened with at least one corresponding relief of the cover. For example, the tabs of the ring have at least one protruding relief and the skirt of the cover has at least one relief defining at least one housing in which this protruding relief is received; in one example, the skirt of the cover has an end part that is folded on itself next to the inner surface of the cover, in order to define, above this fold, said housing for receiving the relief on the ring. The skirt of the cover may have, above the fold, a shoulder which comes to bear axially against said relief. This should forms, with the fold, the abovementioned housing for receiving the relief. The latter may be formed by a rib moulded in one piece with each tab of the ring. A chamfer may extend below the rib, so as to form a space for accommodating the fold.

The lip of the ring may be completely flat and rest on the top of the annular part of the ring, which may also be flat. In this case, the radially inner edge of the lip of the cover may be at a small distance (for example less than 1 mm measured in the radial direction) from the radially inner edge of the annular part of the ring.

The ring may also have, on its upper surface, a positioning ring that forms an upward protrusion, and the cover may bear, with a radially inner edge, substantially against this rib. Such a rib, situated preferably close to the radially inner edge of the annular part of the ring, improves the centring of the cover on the ring. The fact that the lower edge of the lip of the cover is thus set back from the opening brings about case of assembly, snap-fastening and centring.

Where appropriate, the positioning rib and the cover have mutual bearing edges that are bevelled in a complementary manner; the positioning rib may in particular have an upwardly and outwardly inclined edge, such that the bearing of the cover on the groove tends to axially retain the edge of the cover against the annular part of the ring. In addition, in this way, the mechanism is allowed to come axially into abutment against the cover before coming into abutment against the ring, this being advantageous when the cover is metallic.

The lip of the cover may have, close to its radially inner edge, an inwardly and downwardly inclined part; this part may advantageous come to bear against the abovementioned positioning rib. Such an inclined part may keep the lip of the cover spaced apart from the annular part of the rib, except for in a contact zone of the lip of the cover with the ring; this contact zone may be defined by a lower edge corner of the inclined part; the latter may come into contact with the positioning rib by way of an upper edge corner. Such limited contact between the cover and the ring makes assembly easier.

The mechanism may have a base, in particular a metallic base, in which the proximal part is received, this base being designed to be snap-fastened on the case. The base may have a tubular skirt provided with securing reliefs designed to be snap-fastened to the ring.

These securing reliefs may be in the form of bosses, the snap-fastening taking place preferably on a radially inner circular edge of the ring.

The glass body is preferably transparent. The body may be made from recycled glass, or glass comprising a certain proportion of recycled glass, for example at least 20%.

A further subject of the invention is an assembly having at least one device according to the invention and a refill mechanism. The two can be packaged together, where appropriate. The refill mechanism may also be packaged separately.

The invention may be understood better from reading the following detailed description of a non-limiting implementation example thereof and from studying the appended drawing, in which

DETAILED DESCRIPTION

Figure 1:
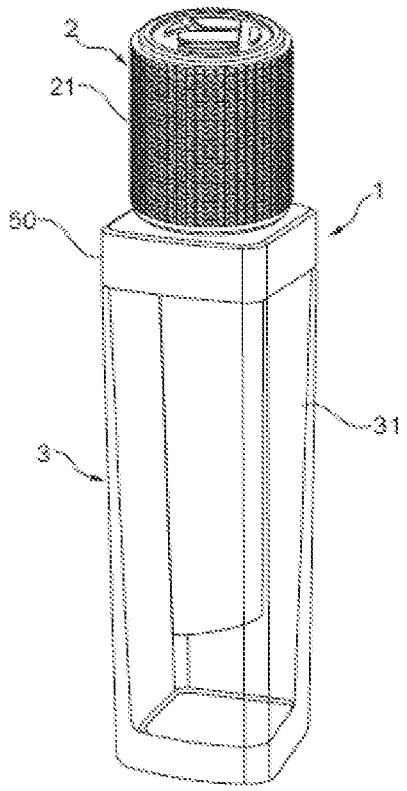
FIG. 1 schematically shows a perspective view of an example of a device according to the invention.

FIG. 1 illustrates a packaging device 1 according to the invention, having a lipstick mechanism 2 and a case 3 to which the mechanism can be secured when not being used to apply the lipstick.

Figure 3:
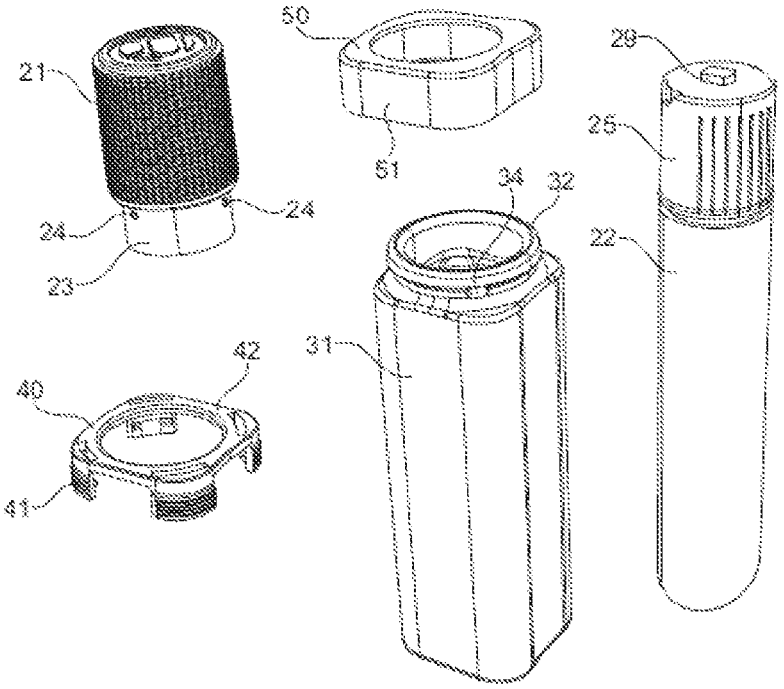
FIG. 3 is an exploded view of the device.

In a conventional way, as can be seen in FIG. 3, the mechanism 2 has a proximal part 25 and a rotary distal part 22, which can rotate with respect to the proximal part 25 in order to axially move a stick-holder cup, which is not visible here.

Figure 2:
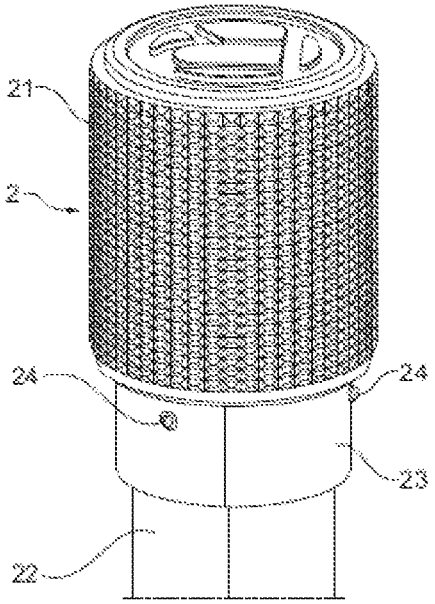
FIG. 2 shows the base of the mechanism.

The proximal part 25 is received in a base 21, visible in FIG. 2, for example a metallic base, being for example force-fitted therein and/or snap-fastened therein or the like.

The proximal part 25 may be provided with a rotation-prevention relief 29 at its end, as illustrated.

The base 21 has a gripping part of larger diameter, provided for example with a surface grid as illustrated, and a tubular mounting skirt 2333 provided with bosses 2433, for example three bosses, distributed evenly at 120° from one another about the longitudinal axis of the mechanism. The outside diameter of the skirt 23 is for example less than or equal to 15 mm, being for example around 14.5 mm.

The base 21 cooperates with the relief 29 such that the proximal part cannot rotation with respect to the base 21.

Figure 4:
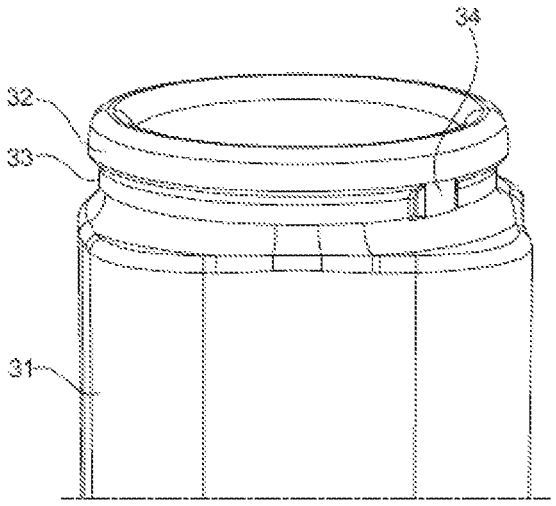
FIG. 4 shows the neck of the glass body of the case.

The case 3 has a body 31 made of, for example transparent, mineral glass having, as illustrated in FIG. 4, a neck 32 at its upper end, on which a ring 40 made of thermoplastic material, covered with a metallic cover 50, is secured. The body 31 is closed at its lower end by a flat bottom.

The neck 32 has a collar forming a radially outward protrusion, which defines, around the neck 32, a groove 33 into which two diametrically opposite positioning reliefs 34 in the form of teeth protrude, only one of these reliefs 34 being visible in FIG. 4.

The body 31 has, for example, below the shoulder at the base of the neck 32, an external cross section that is square with rounded corners.

Figure 5:
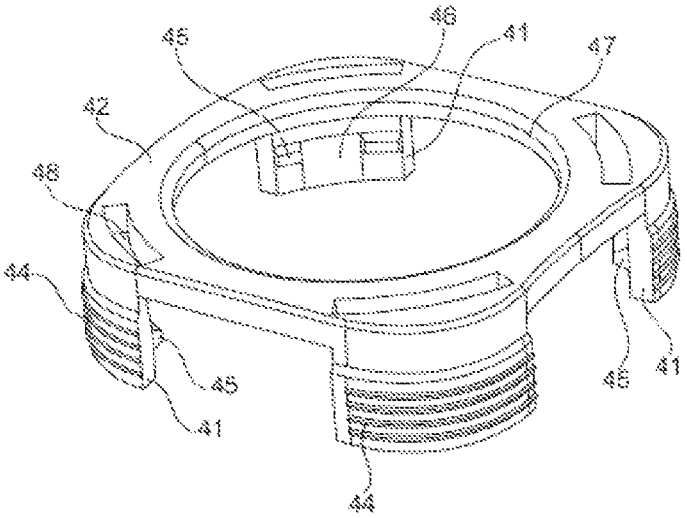
FIG. 5 shows a perspective view of the ring, on its own.
Figure 6:
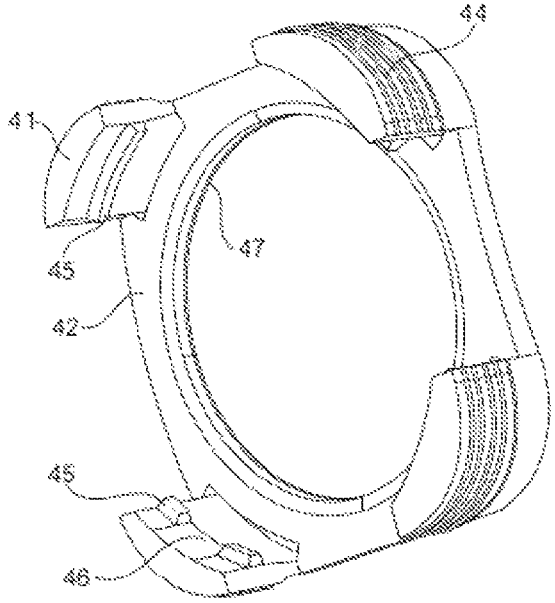
FIG. 6 shows the ring from FIG. 5 at a different viewing angle.

With reference more particularly to FIGS. 5 and 6, it is apparent that the ring 40 has four securing tabs 41 that are connected at the top to an annular part 42.

The external contour of this annular part 42 is substantially square with rounded corners, and each tab 41 is situated at a corner.

Each tab 41 has, on is radially outer face, a series of parallel ribs 44 extending in respective planes that are oriented perpendicularly to the longitudinal axis of the case, and, on its radially inner face, a snap-fastening tooth 45.

Figure 8:
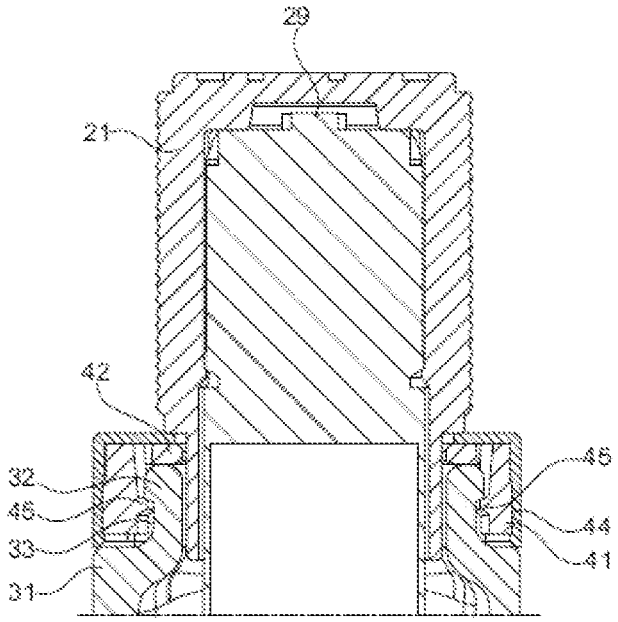
FIG. 8 illustrates the mounting of the ring on the neck.
Figure 9:
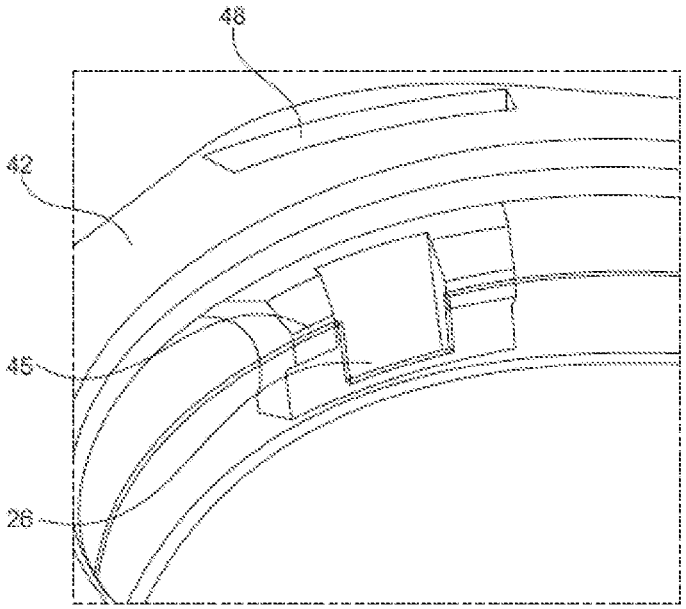
FIG. 9 is an axial, schematic and partial cross section through the device in the closed configuration.

The teeth 45 of two diametrically opposite tabs 41 are interrupted so as to define recesses 46 for the engagement therein of the positioning reliefs 34 on the neck 32, as illustrated in FIG. 8. These reliefs 34, once they are engaged in the recesses 46, prevent the ring 40 from rotating relative to the neck 32.

Slots 48 are provided through the annular part 42, for the passage of a mould for moulding the teeth 45 during the manufacture of the ring 40 by injection moulding.

The cover 50 has an outer skirt 51 which bears on the ribs 44 of the tabs 41, ensuring the retention thereof.

Figure 7:
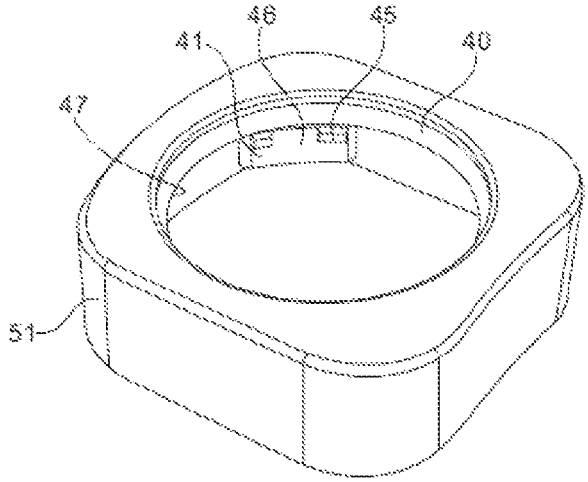
FIG. 7 shows the ring provided with the cover.

To assemble the case 3, the ring 40 can be snap-fastened on the neck 32, then the cover 50 is engaged on said ring 40. In a variant, the ring 40 is disposed in the cover 50 in order to form an assembly as illustrated in FIG. 7, and then the latter is snap-fastened on the neck 32.

Figure 10:
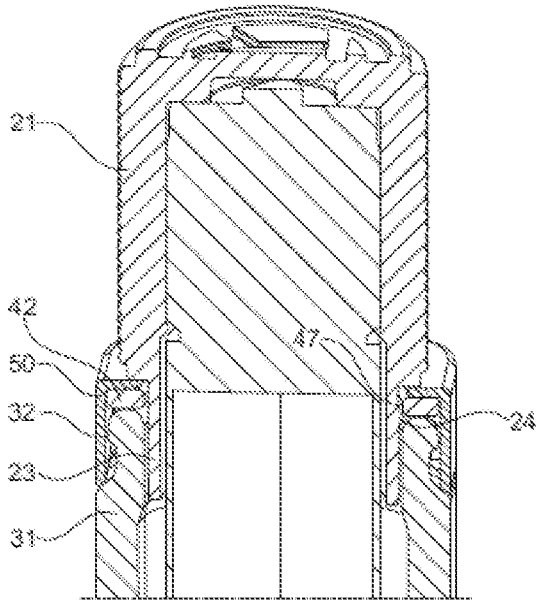
FIG. 10 is a view similar to FIG. 9 in a different section plane.

The annular part 42 of the ring 40 defines a circular opening 47, the diameter of which is slightly greater than that of the securing skirt 23 of the base 21. Thus, the securing skirt 23 can be snap-fastened by means of the bosses 24 on the edge of this opening 47, as illustrated in FIG. 10.

Figure 11:
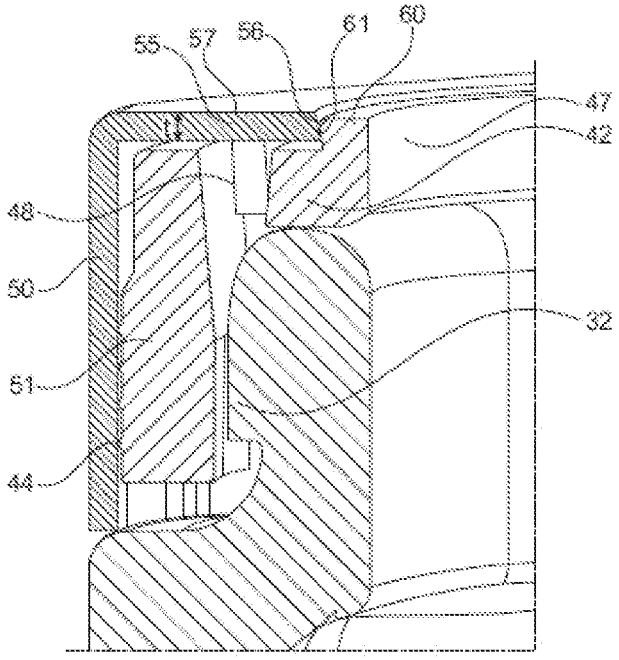
FIG. 11 illustrates an embodiment variant of the ring and of the cover.

In the variant illustrated in FIG. 11, the annular part of the ring has an annular positioning rib 60, which borders the opening 47. This rib 60 is formed by injection-moulding with the rest of the ring 40. It may have a radially outer flank 61 which is inclined slightly outward and upward.

The cover 50 has a lip 55 which extends as far as the flank 61. This lip is, for example, formed as one with the rest of the cover 50. It may have a radially inner edge 56 which is slightly bevelled, with the same inclination as the flank 61, such that the two have complementary shapes allowing one edge to be fitted in the other.

The thickness t of the rib 60 in the direction of the longitudinal axis of the device is preferably, as illustrated, substantially equal to the thickness of the lip 55.

The upper face 57 of the lip 55 may be situated slightly higher up than the upper face of the rib 60, as illustrated.

Figure 12:
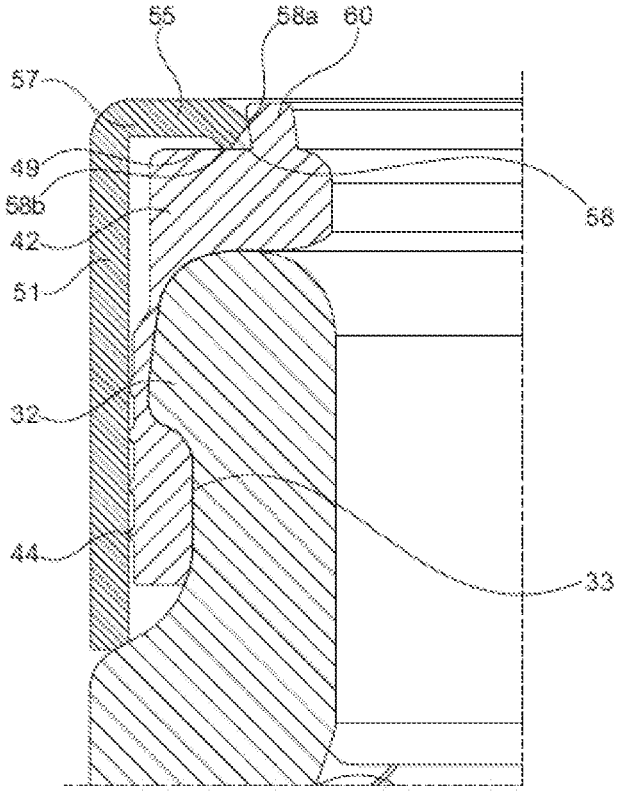
FIG. 12 is a view similar to FIG. 11 of another embodiment variant.

In the variant shown in FIG. 12, the lip 55 of the cover 50 has a flat annular part 57, oriented perpendicularly to the longitudinal axis of the device, which is continued by a downwardly and inwardly inclined end part 58.

The end part 58 may rest, as illustrated, with one edge corner 58*a* against the annular rib 60 and with another edge corner 58*b* against the top of the annular part of the ring about the rib 60.

Figure 13:
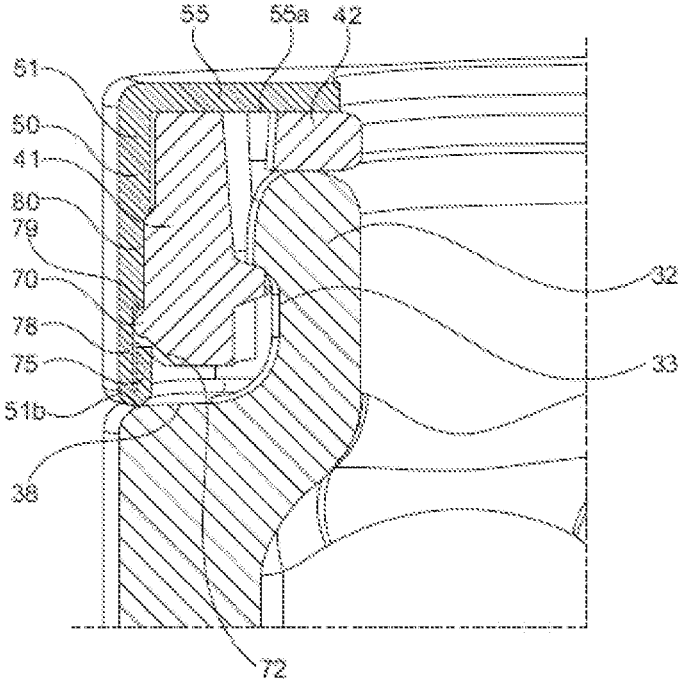
FIG. 13 is a view similar to FIG. 11 of another embodiment variant.

Illustrated in FIG. 13 is the possibility of realizing the retention of the cover 50 by the ring 40 in some other way than by friction by means of the ribs 44.

In this example, the tabs 41 each have, in the vicinity of their lower edge, a retaining rib 70. Each tab 41 has a chamfer 72 under this rib 70.

The outer skirt 51 of the cover 50 may have a thinner lower part 78, which is folded on itself inwardly at its lower end so as to define a fold 75 that is positioned under the rib 70 in order to keep the cover 50 on the ring 40.

The junction between the lower part 78 and the rest of the cover 50 may define a shoulder 79 which comes to bear axially against the rib 70.

In this example, as illustrated, the upper face of the ring 40 may be flat, and the lip 55 of the cover comes to bear, with its lower face 55*a*, against the top of the ring.

During the mounting of the cover 50 on the ring 40, the rib 70 fits in a groove formed between the fold 75 and the shoulder 79, ensuring that the cover 50 is coupled to the ring 40.

The presence of the chamfer 72 frees up a space under the rib 70, which makes it possible to accommodate the fold 75.

The tabs 41 of the ring 40 bearing on the outer skirt of the cover 50 above the rib 70 may have an over thickness 80 in order to achieve the radial clamping desired between the cover 50 and the ring 40. The cover 50 may come to bear, as illustrated, with its lower end 51*b* against a shoulder 38 of the body 31, at the base of the neck 32.

To use the mechanism 2, the user withdraws it from the case 3; the elasticity of the plastics material of the ring 40 allows the bosses 24 to pass over the latter. Next, the user can hold the base 21 between two fingers and rotate the distal part 22 to extend the stick.

Following use, the mechanism 2 is inserted into the case 3 until the bosses 24 have been snap-fastened to the ring 40.

Once the stick has been used up, the user can change the mechanism 2 while keeping the base 21 and the case 3.

Of course, the invention is not limited to the examples that have just been described.

For example, the glass body 31 may be produced with a shape exhibiting symmetry of revolution.

If necessary, the mechanism 2 is produced without the base 21, and it is the proximal part that is configured to be secured directly to the ring 40.

The cover 50 may be made of plastics material.

The mechanism 2 may be secured to the case 3 with sealing, for example by providing a flexible seal.

The invention claimed is:

1. A device for packaging a cosmetic product in the form of a stick comprising:

a distributor mechanism, having a proximal part and a rotary distal part, configured such that a rotary movement of the distal part with respect to the proximal part is accompanied by an axial movement of the stick relative to the proximal part, a case having a body made of mineral glass, in which said mechanism can be fitted and secured, the body having a neck, the case has a ring made of thermoplastic material which is attached and secured to the neck and to which said mechanism is secured.

2. The device according to claim 1, wherein the ring has at least two securing tabs.

3. The device according to claim 2, wherein the neck has at least one positioning relief forming a protrusion on an outer surface of the neck, and at least one of the at least two securing tabs of the ring has a recess for receiving said relief.

4. The device according to claim 3, wherein at least some of the at least two securing tabs have, on a radially inner face, a snap-fastening tooth, said recess being formed by an interruption in the tooth.

5. The device according to claim 2, wherein the ring—has four securing tabs and the neck has two diametrically opposite positioning reliefs.

6. The device according to claim 2, wherein the case has a cover designed to be secured to said ring.

7. The device according to claim 6, wherein the at least two securing tabs have, on their outer face, ribs for retaining the cover, against which the cover bears.

8. The device according to claim 6, wherein the cover is metallic.

9. The device according to claim 6, wherein the ring has at least one first relief which is designed to be snap-fastened with a corresponding second relief on the cover, said at least two securing tabs of the ring have at least one protruding relief and a skirt of the cover having at least one third relief defining at least one housing in which this protruding relief is received, the skirt of the cover having an end part that is folded on itself next to the inner surface of the cover, in order to define, above this fold, said housing for receiving the protruding relief on the ring, the skirt of the cover having, above the fold, a shoulder which comes to bear axially against said protruding relief.

10. The device according to claim 6, wherein i) a lip of the ring is completely flat and rests on a top of an annular part of the ring, which is likewise flat, or, in a variant, ii) the ring has, on an upper surface, a positioning rib that forms an upward protrusion, and the cover bears, with a radially inner edge, against this rib, the positioning rib and the cover having mutual contact edges which are bevelled in a complementary manner, the positioning rib having an upwardly and outwardly inclined edge, such that the bearing of the cover on a groove tends to axially retain the edge of the cover against the annular part of the ring, or, in a variant, iii) the lip of the cover has, close to its radially inner edge, an inwardly and downwardly inclined part, this part coming to bear against the positioning rib.

11. The device according to claim 1, wherein the mechanism has a base in which the proximal part is received, this base being designed to be snap-fastened on the case.

12. The device according to claim 11, wherein the base has a tubular skirt provided with securing reliefs-designed to be snap-fastened on the ring.

13. The device according to claim 12, wherein the securing reliefs are in the form of bosses, the snap-fastening taking place on a radially inner circular edge of the ring.

14. An assembly having at least one device according to claim 1 and a refill mechanism.

15. A device for packaging a cosmetic product in the form of a stick having:

a distributor mechanism, having a proximal part and a rotary distal part, configured such that a rotary movement of the distal part with respect to the proximal part is accompanied by an axial movement of the stick relative to the proximal part, the proximal part having a rotation-prevention relief at its end, a base in which the proximal part is removably received, the base comprising a side wall with a closed circumference, the side wall being closed at one end by a bottom wall, the bottom wall of the base cooperating with the rotation-prevention relief such that the proximal part cannot rotate with respect to the base, a case having a body made of mineral glass, in which said mechanism can be fitted and secured, in which, once the stick has been used up, a user can change the mechanism while keeping the base and the case.

16. A device for packaging a cosmetic product in the form of a stick having:

a distributor mechanism, having a proximal part and a rotary distal part, configured such that a rotary movement of the distal part with respect to the proximal part is accompanied by an axial movement of the stick relative to the proximal part, the proximal part being provided with a rotation-prevention relief at its end, a base in which the proximal part is removably received, the base cooperating with the rotation-prevention relief such that the proximal part cannot rotate with respect to the base, the base comprising a side wall with a closed circumference, the side wall being closed at one end by a bottom wall, a case having a body made of mineral glass, in which said mechanism can be fitted and secured, in which, once the stick has been used up, the user can change the mechanism while keeping the base and the case, the device being deprived of ballast between the bottom wall and the distributor mechanism.

* * * * *